US010158167B2

(12) United States Patent
Huynh

(10) Patent No.: US 10,158,167 B2
(45) Date of Patent: Dec. 18, 2018

(54) IRRIDIUM/INMARSAT AND GNSS ANTENNA SYSTEM

(75) Inventor: Son Huy Huynh, Redondo Beach, CA (US)

(73) Assignee: NovAtel Inc., Calgary, AB (CA)

( * ) Notice: Subject to any disclaimer, the term of this patent is extended or adjusted under 35 U.S.C. 154(b) by 316 days.

(21) Appl. No.: 13/556,903

(22) Filed: Jul. 24, 2012

(65) Prior Publication Data

US 2014/0028520 A1 Jan. 30, 2014

(51) Int. Cl.
*H01Q 1/42* (2006.01)
*H01Q 5/40* (2015.01)
*H01Q 9/04* (2006.01)

(52) U.S. Cl.
CPC ..... *H01Q 1/42* (2013.01); *H01Q 5/40* (2015.01); *H01Q 9/0414* (2013.01)

(58) Field of Classification Search
CPC .. H01Q 9/0407; H01Q 9/0414; H01Q 9/0428; H01Q 9/0435; H01Q 1/48
USPC ..... 343/848, 725
See application file for complete search history.

(56) References Cited

U.S. PATENT DOCUMENTS 5,300,936 A * 4/1994 Izadian ..... H01Q 1/32 343/700 MS
6,335,703 B1 * 1/2002 Chang ..... H01Q 3/20 343/700 MS
6,445,354 B1 9/2002 Kunysz
6,452,560 B2 9/2002 Kunysz
6,642,898 B2 11/2003 Eason
6,836,247 B2 12/2004 Soutiaguine et al.
7,006,043 B1 * 2/2006 Nalbandian ..... H01Q 9/0407 343/700 MS
7,250,916 B2 7/2007 Kunysz et al.
2002/0180643 A1 * 12/2002 Skladany ..... H01Q 1/32 343/700 MS
2003/0146872 A1 * 8/2003 Kellerman ..... H01Q 9/0414 343/700 MS
2004/0021606 A1 * 2/2004 Shigihara ..... H01Q 9/0414 343/700 MS
2004/0027290 A1 * 2/2004 Arvidsson ..... H01Q 9/0407 343/700 MS (Continued)

FOREIGN PATENT DOCUMENTS

EP 0527714 2/1993
EP 1775795 4/2007

OTHER PUBLICATIONS

Nakar, P., Thesis—"Design of a Compact Microstrip Patch Antenna for Use in Wireless/Cellular Devices", Mar. 4, 2004, Florida State University, Chapter 3, pp. 31-47.

(Continued)

*Primary Examiner* — Dameon E Levi
*Assistant Examiner* — Jennifer F Hu
(74) *Attorney, Agent, or Firm* — Cesari and McKenna, LLP

(57) ABSTRACT

A compact packaged antenna system includes a patch antenna with a maximally sized radiating element that is spaced from an antenna ground plane by a gap with a depth selected to provide a desired volume. A second antenna, which is strategically placed above and substantially centered over a central, or low potential, region of the radiating element of the patch antenna may also be included in the packaged antenna system.

19 Claims, 6 Drawing Sheets

(56) References Cited

U.S. PATENT DOCUMENTS

| | | | | |
|---|---|---|---|---|
| 2007/0296635 | A1* | 12/2007 | Popugaev | H01Q 9/0414 343/700 MS |
| 2009/0140930 | A1 | 6/2009 | Tatarnikov et al. | |
| 2010/0097271 | A1* | 4/2010 | Chang | H01Q 1/40 343/700 MS |
| 2011/0012788 | A1 | 1/2011 | Rowell et al. | |
| 2011/0032154 | A1* | 2/2011 | Chung | H01Q 9/0414 343/700 MS |
| 2011/0115676 | A1 | 5/2011 | Tatarnikov et al. | |

OTHER PUBLICATIONS

Cisco Systems: "Antenna Patterns and Their Meaning", (White Paper), copyright 1992-2007, pp. 1-17.
Orban, D. et al, "The Basics of Patch Antennas", Aug. 31, 2005, Orban Microwave Products.
Su, C. et al., "Broadband Circularly Polarized Planar Patch Antenna With a Folded Ground Plane", Dec. 2005, 2005 International Symp. on Communications, Kaohsiung, Taiwan.
Breed, G, "The Fundamentals of Patch Antenna Design and Performance", Mar. 2009 High Frequency Electronics, Summit Technical Media, LLC, pp. 48-51.

* cited by examiner

IRRIDIUM/INMARSAT AND GNSS ANTENNA SYSTEM

BACKGROUND OF THE INVENTION

Field of the Invention

The invention relates generally to antennas and, in particular, to antennas for receiving GNSS signals and Irridium and/or Inmarsat signals.

Background Information

Devices that utilize GNSS satellite signals for position determination may also utilize Irridium and/or Inmarsat signals for two-way communications. Further, the Irridium and/or Inmarsat signals may provide GNSS differential and satellite correction information that is utilized, in a known manner, along with the GNSS signals for precise position determination. For convenience, the term "Inmarsat signals" is used hereinafter to refer singly and collectively to the Irridium and/or Inmarsat signals.

The Inmarsat signals are transmitted from satellites that have geostationary orbits at the equator. The GNSS signals are transmitted from satellites that are not geostationary but instead circle the earth in predetermined paths. The Inmarsat signals arrive at an Inmarsat antenna at azimuth angles that correspond to the distance of the antenna from the equator while the GNSS signals arrive at a GNSS antenna at azimuth angles that change throughout the day as the respective GNSS satellites circle the earth. The frequency bands of the GNSS signals and the Inmarsat signals are relatively close and both types of signals are right-hand-circularly-polarized (RHCP). Accordingly, known prior systems may utilize a single antenna for both signals, though the signal quality of particularly the Inmarsat signals is adversely affected since the antenna is not typically optimized for the Inmarsat signals.

Separate conventional GNSS and Inmarsat antennas may be utilized for the GNSS and the Inmarsat signals. The antennas are, however, likely to be placed in relatively close proximity to one another. Accordingly, the two antennas will thus interfere with one another, such that signal quality at the respective antennas is adversely affected. Further, the use of the two conventional antennas adds bulk to the devices, which like many consumer devices are getting smaller in size.

SUMMARY OF THE INVENTION

A compact packaged antenna system includes a first patch antenna, with a maximally sized radiating element that is spaced from an antenna ground plane by a relatively large gap with a depth selected to provide a desired volume.

A second antenna that is strategically placed above the radiating element of the patch antenna may be included in the compact packaged antenna system.

The compact packaged antenna system further includes a first antenna feed network that includes a plurality of relatively large diameter RF connector probes that are strategically sized and spaced to provide, to and from the radiating element of the first antenna, signals having essentially the same amplitude and different phases.

The gap may be air-filled and the radiating element have a length of 0.5λ, the RF connectors are sized to span the air gap and have diameters selectively sized from 0.01λ to 0.018λ, with the air gap selectively sized from 0.02λ to 0.07λ, to provide the desired volume, where λ is the wavelength of the signals of interest. The second antenna may be substantially centered over the first antenna.

BRIEF DESCRIPTION OF THE DRAWINGS

The invention description below refers to the accompanying drawings, of which.

DETAILED DESCRIPTION OF AN ILLUSTRATIVE EMBODIMENT

A compact packaged antenna system is described below in terms of antennas for Inmarsat and/or Irridium signals (hereinafter referred to singly and collectively as "the Inmarsat signals") and GNSS signals, which in the example may be GPS signals. For convenience the antenna designed to transmit and receive the Inmarsat signals is referred to herein as the Inmarsat antenna. The antenna system may instead consist of antennas that receive and/or transmit other signals, with the two antennas sized appropriately for the respective signal wavelengths as well as relative to one another.

Figure 1:
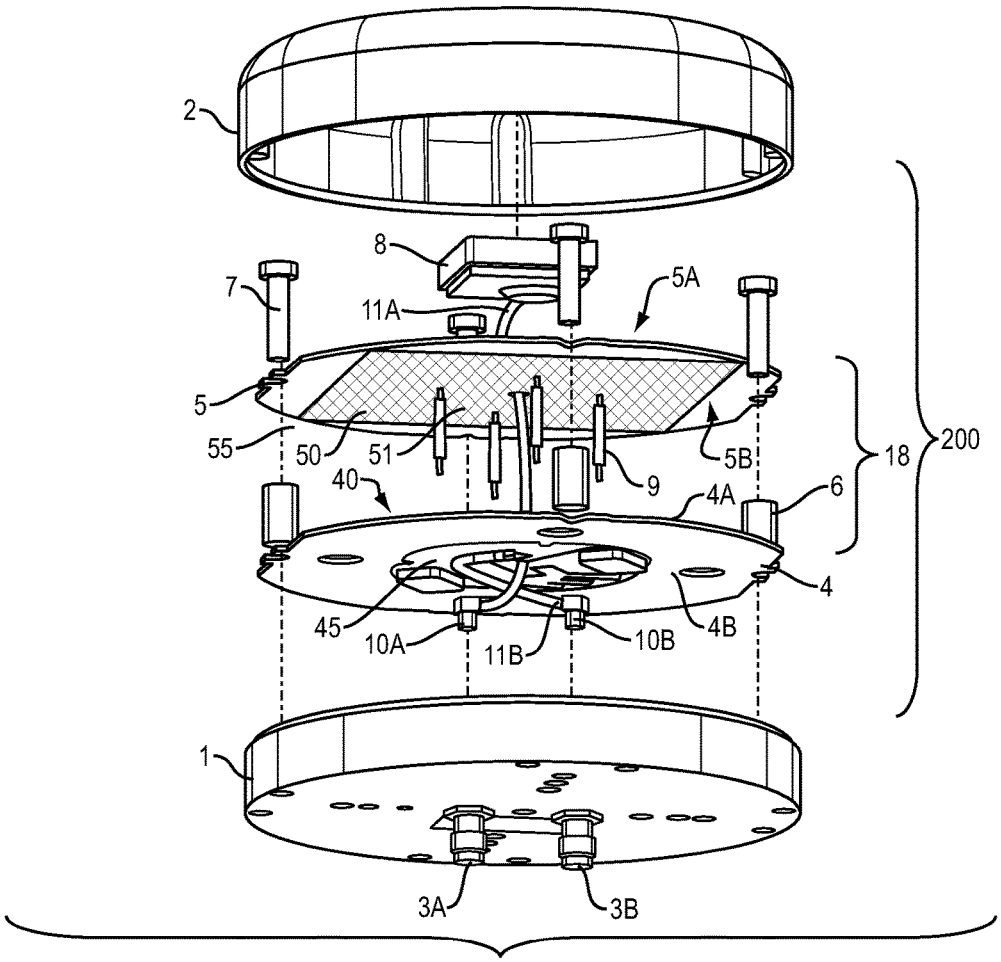
FIG. 1 is an expanded view of a packaged antenna system that is constructed in accordance with the invention.

Referring now to FIG. 1, a compact packaged antenna system includes an Inmarsat antenna 18, which is a patch antenna that consists of a maximally sized radiating element 50 and an antenna ground plane 40 that are separated by a gap 55. The packaged antenna system also includes a GNSS antenna 8 that operates in a known manner and is positioned above a central, low potential, region 51 of the radiating element 50 of the Inmarsat antenna 18. The GNSS antenna 8 and the Inmarsat antenna 18 are sized and strategically placed relative to one another to minimize coupling between the two antennas, as discussed in more detail below.

As also discussed below, the gap 55 is strategically sized to provide a desired volume, to improve signal bandwidth. A plurality of RF connector probes 9 that are part of an antenna feed network span the gap 55 and are strategically sized with relatively large diameters and are further strategically positioned with respect to the edges of the radiating element to increase antenna gain. The probes 9 are also spaced to provide signals having essentially the same power, or amplitude, and different phases corresponding to the right-hand circularly polarized (RHCP) signals.

Figure 2A:
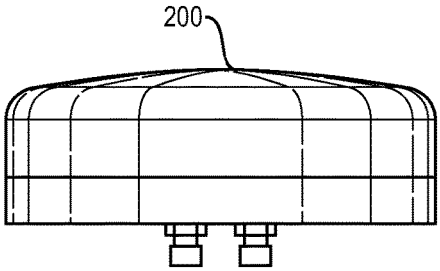
FIGS. 2A-B show the packaged antenna systems of FIG. 1 fully assembled.
Figure 2B:
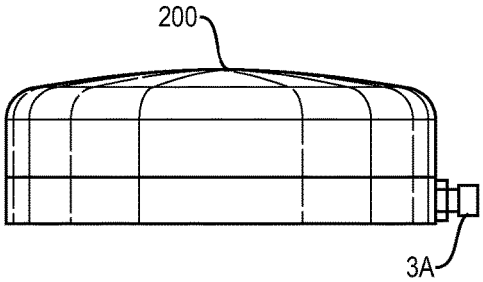

Before discussing the Inmarsat antenna 18 in more detail, the arrangement of the two antennas 8, 18 within a case 200 formed by a radome 2 and a base plate 1 is discussed. Referring still to FIG. 1, the radome 2 and a base plate 1 are interconnected by screws 7 that extend through spacers 6 that span the air gap 55. The radome 2 and base plate 1 are sized and shaped to fully enclose the antennas as depicted in FIGS. 2A and 2B. The base plate 1 includes a connector 3A that provides signals received by the GNSS antenna 8 to the outside of the packaged antenna system and a connector 3B that provides signals between the Inmarsat antenna 18 and the outside of the packaged antenna system. The connectors 3A and 3B may instead be positioned at a side of the base plate, as illustrated in FIG. 2B, in which one of the connectors 3B is hidden from view.

A cable 11A provides an isolated path for the signals from the GNSS antenna to a connector 10A, which connects, in turn, to the connector 3A at the base plate 1. The cable 11A, which may be, for example, a coaxial cable, extends from the GNSS antenna 8 through substantially the center of the Inmarsat antenna 18 to the connector 10A. A cable 11B provides signals to and from the Inmarsat antenna feed circuit 45 to a connector 10B, which connects, in turn, to the connector 3B.

Figure 3:
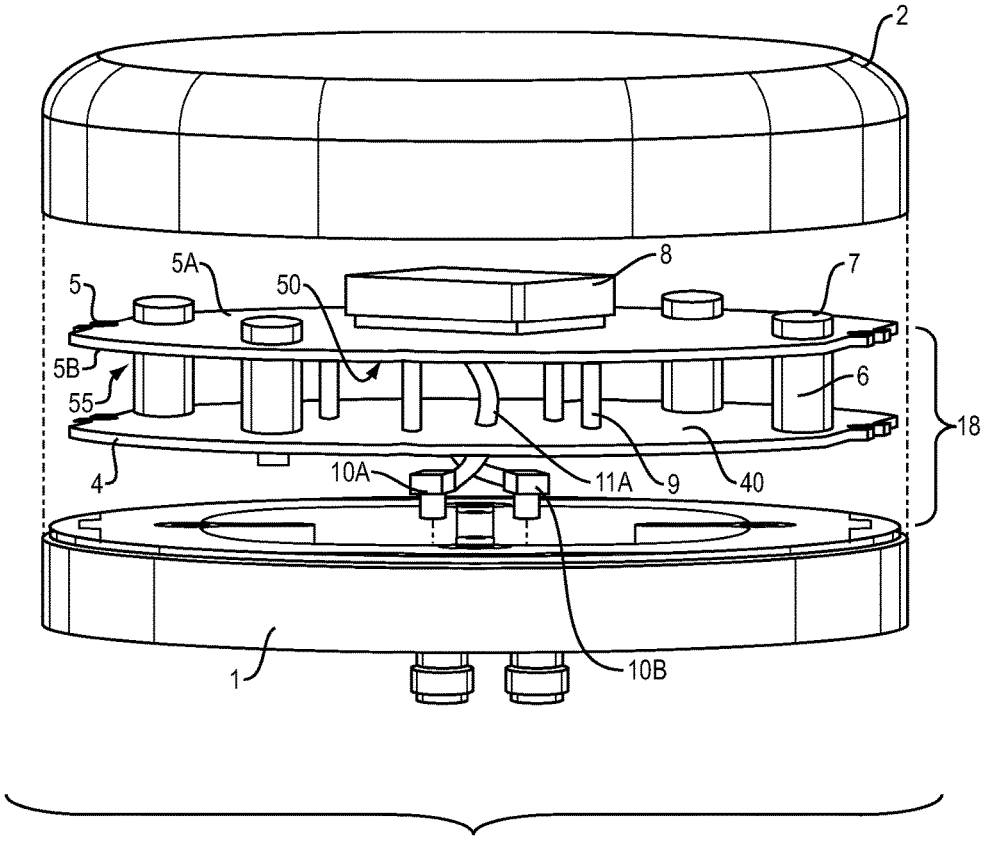
FIG. 3 shows the antenna system of FIG. 1 partially assembled.

Referring now also to FIG. 3, the GNSS antenna 8 is isolated from the Inmarsat antenna 18 by a substrate 5, which has a non-metallized top side 5A that supports the GNSS antenna 8 and a bottom side 5B that supports the radiating element 50 of the Inmarsat antenna 18. The substrate 5 may, for example, be a printed circuit board (PCB). The top surface 5A of the PCB 5 may serve also as a radome cover for the underlying radiating element of the Inmarsat antenna 18.

Figure 4:
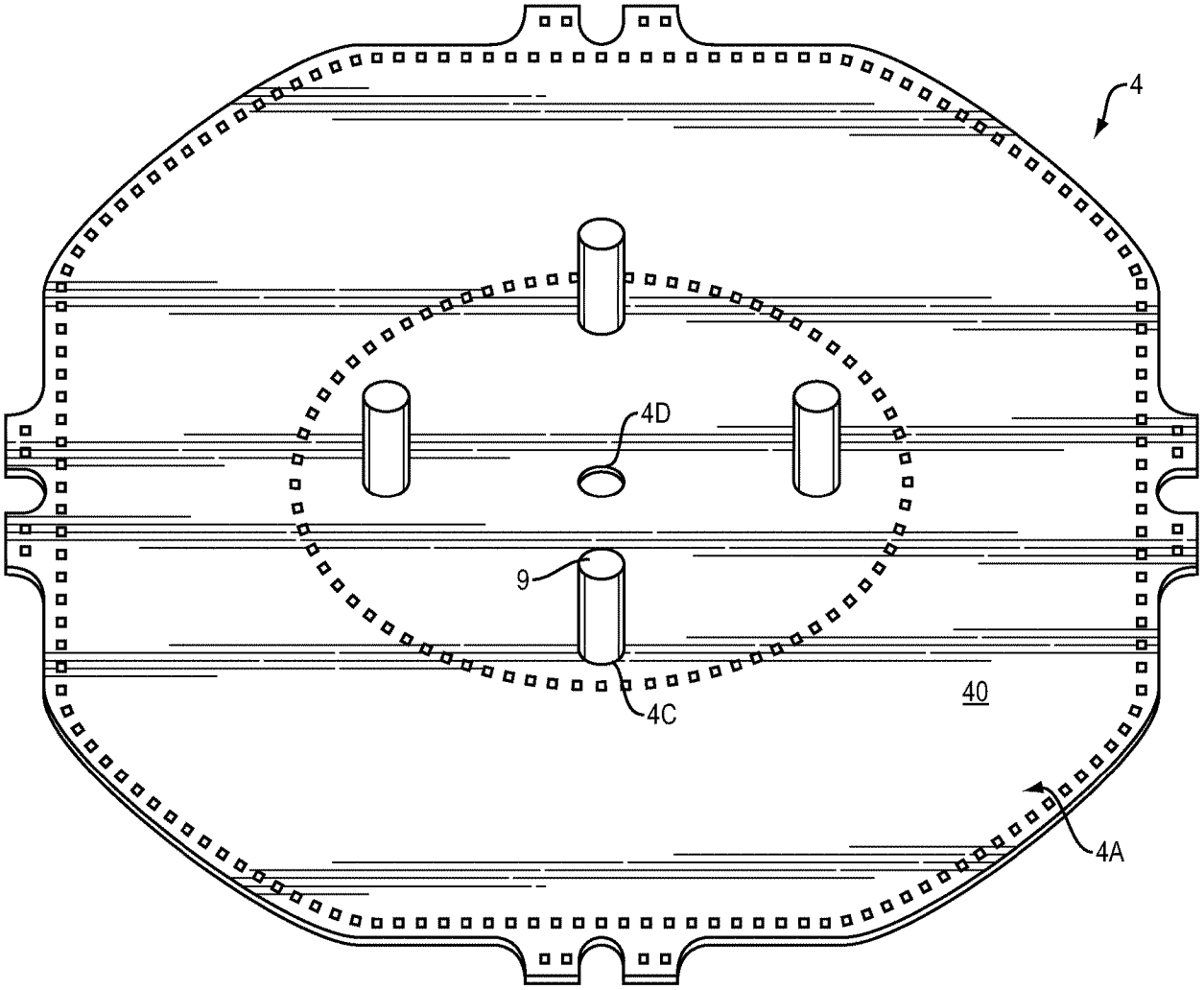
FIG. 4 shows an antenna ground plane of the system of FIG. 1 in more detail.

Referring now also to FIG. 4, the Inmarsat antenna ground plane 40 is formed as a metallized top surface 4A of a coupler PCB 4. The antenna ground plane 40 serves also as the ground plane of the antenna feed circuit 45, which is formed on the bottom surface 4B of the coupler PCB 4. Clearance holes 4C extend through the ground plane 40 and the PCB substrate, to prevent DC shorting at the vertical transition locations to the feed circuit 45. As also illustrated, the ground plane 40 includes a center hold 4D through which the cable 11A extends.

Figure 5:
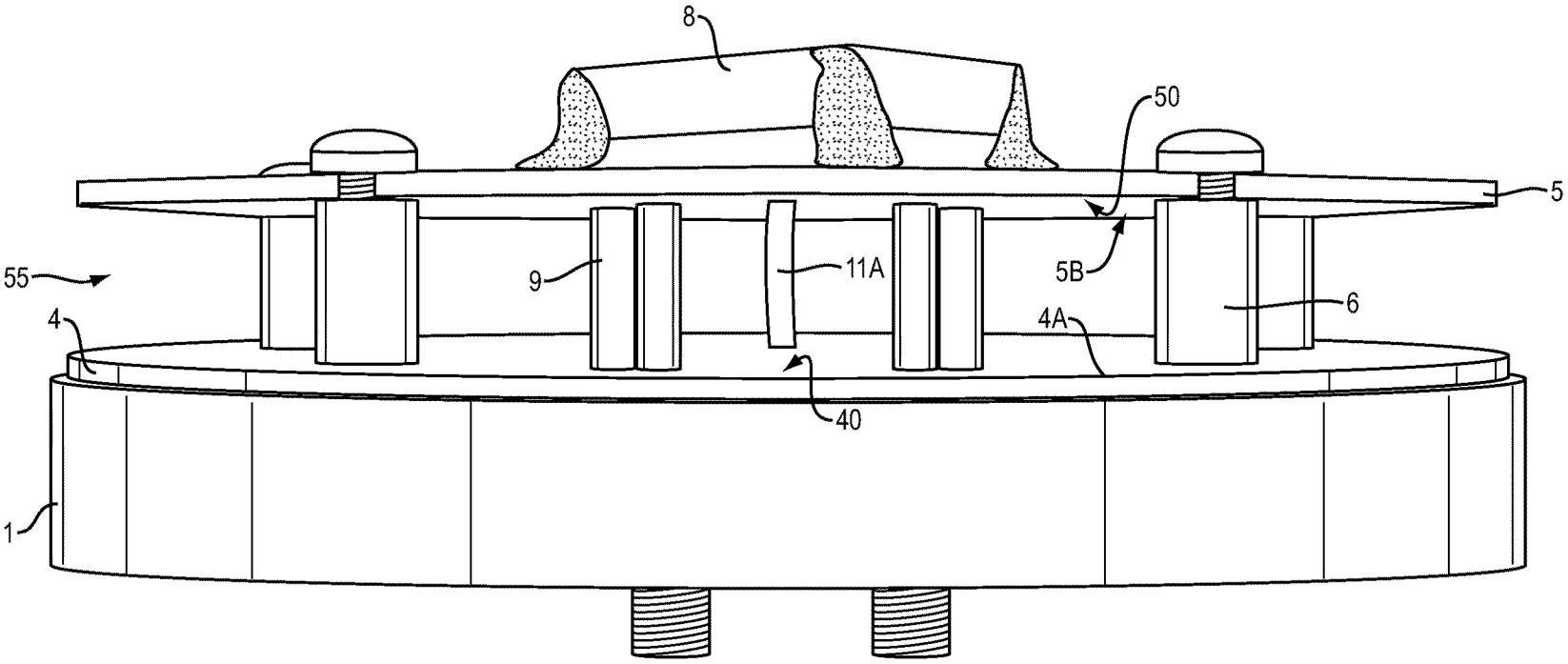
FIG. 5 shows an air gap of the system of FIG. 1 in more detail.

Referring also to FIG. 5, the Inmarsat radiating element 50, which is on the bottom of the PCB 5 is separated from the Inmarsat antenna ground plane 40, which is on the top surface of the coupler PCB 4, by the gap 55. Two or more spacers 6 separate the two PCBs 4 and 5. A spacer PCB (not shown) may be used instead or in addition, to vertically span the outer diameter of the gap 55, and thus, extend between the PCBs 4 and 5.

The gap 55 is strategically sized to provide a desired, relatively large volume for controlling the frequency bandwidth and also for increased gain, particularly at the band edges. The gap size is selected as a trade-off of gain at the center frequency versus bandwidth and gain at the high and low ends of the frequency band. The Inmarsat antenna 18 uses air as the dielectric between the radiating element 50 and the antenna ground plane 40. Air is selected for use in the gap 55 in order to maximize the size of the radiating element 50. The length of the maximally-sized radiating element is $0.5\lambda/\sqrt{\varepsilon}$, where $\lambda$ is the wavelength of interest, here the Inmarsat signal wavelength, and $\varepsilon$ is the dielectric constant of air, which is essentially 1. Thus, the radiating element 50 has a maximized length of essentially $0.5\lambda$. To accommodate the circularly polarized signals, the radiating element has the same width, namely, $0.5\lambda$. The maximized size of the radiating element provides the antenna with improved gain for signals arriving at both high and low elevation angles. The gap depth is selectively sized from $0.02\lambda/\sqrt{\varepsilon}$, to $07\lambda/\sqrt{\varepsilon}$, to provide the desired volume, and thus, with the air-filled gap from $0.02\lambda$ to $0.07\lambda$.

The Inmarsat antenna ground plane 40, which is on the top surface 4A of the coupler PCB 4, is strategically sized to provide improved signal quality with a minimum back lobe. The antenna ground plane is thus selectively sized from 1 to 1.5 times the size of the radiating element 50.

There are four RF connector probes 9, which are strategically sized and located to provide, to the feeder circuit 45, signals that have essentially the same amplitude and phase differences of −90° between neighboring probes in a counterclockwise direction. The probes, which extend through the gap 55, thus have a length that corresponds to the selected size of the gap 55, i.e. $0.02\lambda$ to $0.07\lambda$. To provide signals with equal and maximized power, the diameters of the probes are selectively sized from $0.01\lambda$, to $0.018\lambda$. The probe diameter is selected for better matching, based on the selected gap size. Further, the respective probes are located a distance of approximately ⅓ of the length of the radiating element 50, i.e., in the example, $0.17\lambda$, away from the corresponding edges of the radiating element. As appropriate, the probes may be selectively placed closer to the edges, to optimize the antenna gain and return loss ratio (VSWR).

Figure 6B:
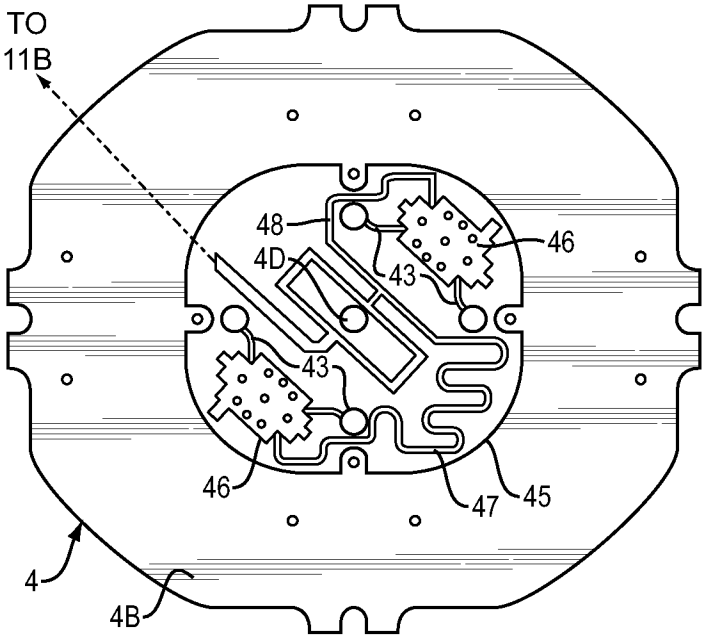
FIGS. 6A-B show an antenna feed circuit of the system of FIG. 1 in more detail.
Figure 6A:
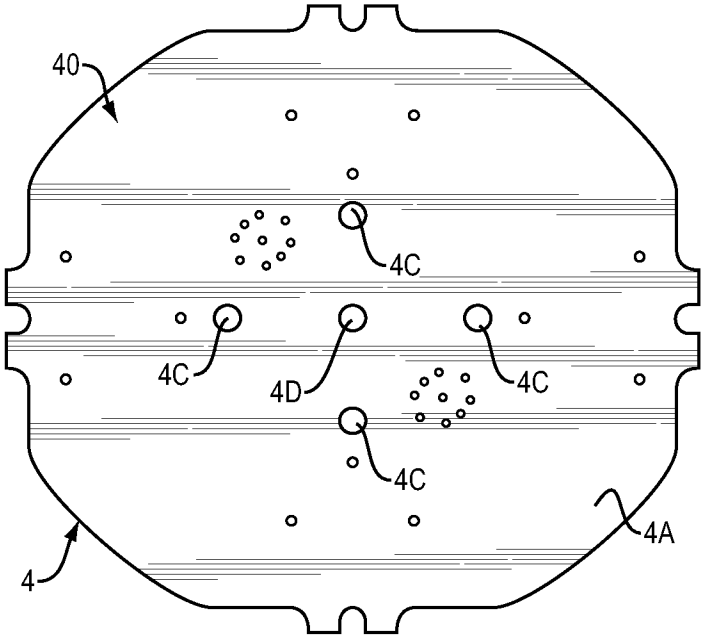

Referring also to FIG. 6, the feed circuit 45 on the bottom surface 4B of the coupler PCB 4 has a compact layout with a well defined perimeter. The feed circuit 45 includes one or more couplers 46, here two are shown, that are connected to communicate with the probes 9 over lines 43. As discussed, the probe signals have equal amplitudes and −90° phase differences from their respective neighboring probes in the counter clockwise direction. The one or more couplers 46 thus operate in a known manner to provide to the respective probes signals that have the proper phase differences and provide to the cable 11B RF signals that correspond to the received RHCP signals. Accordingly, circuit feed lines 47 and 48 have appropriate relative lengths. As discussed, the feed circuit 45 may utilize a single quad-coupler (not shown) that operates in a known manner in place of the two couplers shown in the drawing. Further, the feed circuit layout accommodates the cable 11A running through the antenna center.

The antenna ground plane 40, which is on the top surface 4A of the PCB 4, acts also as a ground plane to the feed circuit 45. By arranging the ground plane 40 and the feed circuit 45 on opposite sides of a single PCB 4, separate PCBs for the antenna ground plane 40 and the feed circuit 45 (with its own dedicated ground plane) are not required. Thus, the overall size of the packaged antenna system, as well as the cost, is reduced.

The GNSS antenna 8 may be sized to a fraction of the size of the Inmarsat antenna radiating element 50. The relative small size of the GNSS antenna allows for the centering of the GNSS antenna above the center region 51 of the large radiating element 50, such that the GNSS antenna is positioned over the region of low potential of the radiating element 50. Accordingly, the adverse affects of any coupling between the GNSS antenna and the Inmarsat antenna are minimized.

Figure 7:
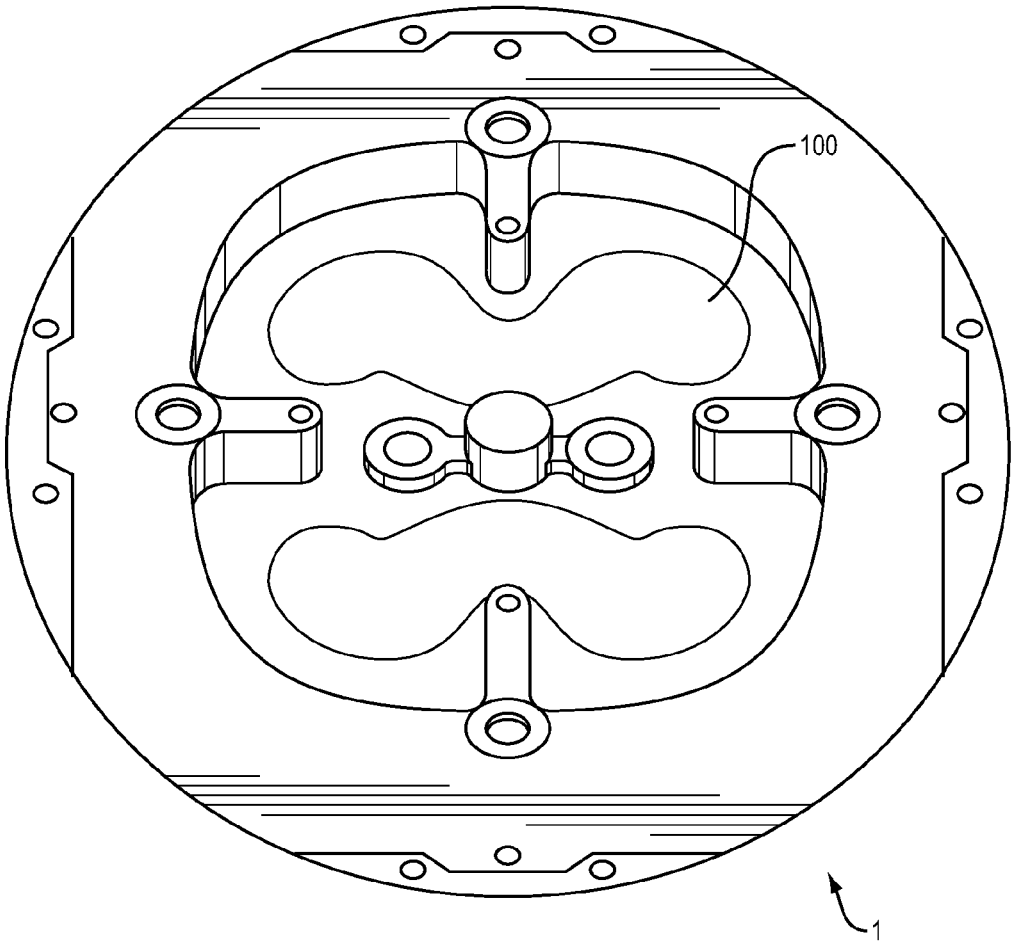
FIG. 7 shows a base plate of the system of FIG. 1 in more detail.

Referring also to FIG. 7, the base plate 1 may be constructed with cutout regions 100 that provide room for the ends of the cables 11A and 11B and connectors 10A and 10B. As appropriate, packing material (not shown) may be inserted into the cutout regions 100, to protect the system components.

The compact packaged antenna system described above provides improved Inmarsat functionality, such as increased bandwidth and increased gain of up to 6 dB, without sacrificing GNSS signal quality. Certain improvements in gain and increases in bandwidth are maintained even if the signals from the GNSS antenna 8 are routed through the system differently, that is, the cable 11A takes a different path through or around the Inmarsat antenna 18.

As discussed, the antennas included in the system may be antennas optimized for signals of wavelengths other than those of the GNSS signals and the Inmarsat signals. The GNSS antenna 8 may, but is not required to, be a patch antenna. As shown, the GNSS antenna is packaged in a conventional manner though the size of the GNSS antenna is preferably, though not required to be, small in comparison to the Inmarsat patch antenna, for example about one-third or less of the size of the Inmarsat radiating element 50. The compact packaged antenna system will operate with improved gain and bandwidth with the GNSS antenna in other positions above the Inmarsat antenna, i.e., in other than a centered position, and/or with other sizes of the GNSS antenna, though the overall improvement in performance may be somewhat reduced. The GNSS antenna 8 is otherwise constructed in and operates in a known manner.

The gap 55 between the Inmarsat antenna radiating element 50 and ground plane 40 is described as filled with air. The gap may instead be filled with a substance with a relatively low dielectric constant, with a corresponding reduction in the size of the radiating element 50. The improvements in overall performance of the system will, with such a configuration, be reduced.

As discussed, the Inmarsat antenna 18 may be used without the inclusion of the GNSS antenna 8 in the package. The Inmarsat antenna, with the maximally sized radiating element 50, the relatively large gap 55 selectively sized to provide a desired volume and the relatively large diameter probes operates with improved gain and bandwidth of conventional Inmarsat antennas.

What is claimed is:

1. A packaged antenna system including:

a first antenna for receiving and transmitting signals of a first wavelength of interest λ, the first antenna being a patch antenna and having first antenna radiating element, a first antenna ground plane and a gap between the first antenna radiating element and the first antenna ground plane with the depth of the gap selected to provide a desired volume, a plurality of spacers spanning the gap and separating the first antenna radiating element and the first antenna ground plane, wherein the first antenna ground plane is formed on a top surface of a first substrate and serves also as a ground plane for a feeding circuit that is included in a feeding network, the feeding circuit being formed on a bottom surface of the first substrate, wherein the feeding circuit is operatively connected to a first connector, and wherein the radiating element of the first antenna is on a bottom side of a second substrate and a top side of the second substrate supports a second antenna, the top side of the second substrate isolating the second antenna from the radiating element of the first;

the second antenna for receiving signals of a second wavelength of interest, the second antenna positioned above and substantially centered over a region of low potential of the radiating element of the first antenna, wherein the second antenna is connected to a second connector; and a base plate that has a third connector and a fourth connector external to the packaged antenna system, wherein the first connector is connected with the third connector via a first coaxial cable that provides a first isolated signal path for the first antenna and the second connector is connected with the fourth connector via a second coaxial cable.

2. The packaged antenna of claim 1 wherein the gap is filled with air, the radiating element has a length of 0.5λ, and the gap has a selected depth of 0.02λ to 0.07λ, to provide the desired volume.

3. The packaged antenna system of claim 2 wherein the first antenna further includes a feed network that includes a plurality of RF connector probes that provide signals to and from the first antenna radiating element, the probes having strategically sized diameters and being spaced to provide signals having essentially the same amplitude and different phases, the RF connectors being sized to span the gap and having diameters selectively sized from 0.01λ to 0.018λ.

4. The packaged antenna system of claim 1 wherein the gap has a selected depth of $0.02\lambda/\sqrt{\varepsilon}$, to $0.07\lambda/\sqrt{\varepsilon}$, to provide the desired volume.

5. The packaged antenna system of claim 4 wherein the signals of the first wavelength are right-hand circularly polarized signals and four probes are utilized with a given probe spaced from neighboring probes to provide signals with phase differences of −90 degrees from the signals provided by the neighboring probes in a counterclockwise direction.

6. The packaged antenna system of claim 5 wherein the respective probes are spaced from corresponding edges of the radiating element by approximately one-third of the length of the radiating element.

7. The packaged antenna system of claim 1 wherein the first antenna ground plane is selectively sized from 1 to 1.5 times the size of the first radiating element.

8. The packaged antenna system of claim 1 wherein the top side of the second substrate is not metalized.

9. The packaged antenna system of claim 8 wherein top side of the second substrate is used as a radome cover for the first antenna radiating element.

10. The packaged antenna system of claim 1 wherein the second antenna is sized to a fraction of the size of the first antenna radiating element.

11. A packaged antenna system including:

a first antenna for receiving and transmitting signals of a first wavelength of interest λ, the first antenna being a patch antenna and having a first antenna radiating element with a length of 0.5λ, a first antenna ground plane and an air gap between the first antenna radiating element and the first antenna ground plane, the depth of the air gap selectively sized to provide a desired volume, a plurality of spacers spanning the gap and separating the first antenna radiating element and the first antenna ground plane, wherein the first antenna ground plane is formed on a top surface of a first substrate, wherein the first antenna radiating element is on a bottom side of a second substrate;

a second antenna for receiving signals of a second wavelength of interest, wherein the second antenna is supported on a top side of the second substrate;

a first antenna feed network that includes a plurality of RF connector probes that have strategically sized diameters and are spaced to provide signals having the same amplitude and different phases to and from the first antenna radiating element, the RF connectors being sized to span the air gap and having diameters selectively sized from 0.01λ to 0.018λ, wherein the first antenna feed circuit is formed on a bottom surface of the first substrate, wherein the first antenna feed circuit is operatively connected to a first connector;

wherein the second antenna is connected to a second connector; and a base plate that has a third connector and a fourth connector external to the packaged antenna system, wherein the first connector is connected with the third connector via a first coaxial cable that provides a first isolated signal path for the first antenna and the second connector is connected with the fourth connector via a second coaxial cable.

12. The packaged antenna system of claim 11 wherein the signals of the first wavelength are right-hand circularly polarized signals and a given probe is spaced from neighboring probes to provide signals with phase differences of −90 degrees from the signals provided by the neighboring probes in a counterclockwise direction.

13. The packaged antenna system of claim 12 wherein the air gap has a depth selectively sized from 0.02λ to 0.07λ to provide the desired volume.

14. The packaged antenna system of claim 11 wherein the second antenna is substantially centered over the first antenna.

15. A packaged antenna system including:

a first antenna for receiving and transmitting signals of a first wavelength of interest λ, the first antenna being a patch antenna and having a first antenna radiating element, a first antenna ground plane and a large gap between the first antenna radiating element and a first antenna ground plane, with the depth of the gap selected to provide a desired volume, a plurality of spacers spanning the gap and separating the first antenna radiating element and the first antenna ground plane;

a first antenna feed network that includes a plurality of RF connector probes that have large diameters and are sized to span the air gap;

wherein the first antenna ground plane is formed on a top surface of a first substrate and wherein the first antenna feed circuit is formed on a bottom surface of the first substrate, wherein the first antenna feed circuit is operatively connected to a first connector; and wherein the first antenna radiating element is formed on a bottom surface of a second substrate; and a base plate that has a third connector external to the packaged antenna system, wherein the first connector is connected with the third connector via a coaxial cable that provides an isolated signal path for the first antenna.

16. The packaged antenna system of claim 15 wherein the gap has a depth selectively sized from $0.02\lambda/\sqrt{\varepsilon}$, to $0.07\lambda/\sqrt{\varepsilon}$, to provide the desired volume, and the probes have diameters selectively sized from 0.01λ to 0.018λ.

17. The packaged antenna system of claim 16 wherein the gap is air-filled.

18. The packaged antenna system of claim 15 further including a second antenna for receiving signals of a second wavelength of interest, the second antenna positioned above and substantially centered over a region of low potential of the radiating element of the first antenna.

19. The packaged antenna system of claim 18 wherein the second antenna is sized to a fraction of the size of the first antenna radiating element.

* * * * *